US012747538B2

(12) United States Patent
Heiskanen et al.

(10) Patent No.: US 12,747,538 B2
(45) Date of Patent: Sep. 29, 2026

(54) METHOD FOR PRODUCING A MULTILAYER MACHINE GLAZED PAPER COMPRISING HIGHLY REFINED CELLULOSE FIBERS AND A MULTILAYER MACHINE GLAZED PAPER PRODUCED

(71) Applicant: Stora Enso OYJ, Helsinki (FI)

(72) Inventors: Isto Heiskanen, Imatra (FI); Kaj Backfolk, Lappeenranta (FI); Anna Kauppi, Lappenranta (FI); Jukka Kankkunen, Imatra (FI); Juha Korvenniemi, Oriniemi (FI)

(73) Assignee: Stora Enso OYJ, Helsinki (FI)

( * ) Notice: Subject to any disclaimer, the term of this patent is extended or adjusted under 35 U.S.C. 154(b) by 101 days.

(21) Appl. No.: 18/042,116

(22) PCT Filed: Aug. 31, 2021

(86) PCT No.: PCT/IB2021/057942

§ 371 (c)(1),
(2) Date: Feb. 17, 2023

(87) PCT Pub. No.: WO2022/049484

PCT Pub. Date: Mar. 10, 2022

(65) Prior Publication Data

US 2024/0003092 A1 Jan. 4, 2024

(30) Foreign Application Priority Data

Sep. 1, 2020 (SE) ..... 2051027-7

(51) Int. Cl.
*D21H 27/38* (2006.01)
*D21H 11/18* (2006.01)
*D21H 25/12* (2006.01)

(52) U.S. Cl.
CPC ..... *D21H 27/38* (2013.01); *D21H 11/18* (2013.01); *D21H 25/12* (2013.01)

(58) Field of Classification Search
CPC ..... D21H 27/38; D21H 11/18; D21H 25/12; D21H 27/30; D21H 25/005; D21H 25/04; D21F 11/04; B32B 29/005
See application file for complete search history.

(56) References Cited

U.S. PATENT DOCUMENTS

| | | | | |
|---|---|---|---|---|
| 2,999,787 | A | 9/1961 | Downs et al. | |
| 4,166,001 | A | 8/1979 | Dunning et al. | |
| 4,225,382 | A * | 9/1980 | Kearney | D21F 1/0027 162/111 |
| 4,287,021 | A * | 9/1981 | Justus | D21F 3/0218 100/153 |
| 10,364,533 | B2 | 7/2019 | Heiskanen et al. | |
| 10,927,504 | B2 | 2/2021 | Backfolk et al. | |
| 11,578,463 | B2 | 2/2023 | Saukkonen et al. | |
| 2002/0048674 | A1 | 4/2002 | Taipale | |
| 2016/0016717 | A1* | 1/2016 | Toubeau | D21H 17/24 220/62.13 |
| 2018/0245289 | A1* | 8/2018 | Heiskanen | D21H 19/36 |
| 2019/0234020 | A1* | 8/2019 | Backfolk | D21H 27/38 |
| 2020/0022538 | A1 | 1/2020 | Ziegenbein | |
| 2020/0023627 | A1 | 1/2020 | Heiskanen et al. | |
| 2020/0173109 | A1 | 6/2020 | Saukkonen et al. | |
| 2020/0223178 | A1 | 7/2020 | Zeigenbein | |
| 2020/0340183 | A1 | 10/2020 | Cunha et al. | |

FOREIGN PATENT DOCUMENTS

| | | | |
|---|---|---|---|
| CN | 104005267 | A | 8/2014 |
| CN | 104285006 | A | 1/2015 |
| CN | 109415875 | A | 3/2019 |
| CN | 111479859 | A | 7/2020 |
| EP | 0312512 | A1 | 4/1989 |
| EP | 2669432 | A1 | 12/2013 |
| EP | 3202979 | A1 | 8/2017 |
| JP | S5040808 | A | 4/1975 |

(Continued)

OTHER PUBLICATIONS

Gavelin G., 1.Egenskaper hos papp och kartong; 1.2 Uppbyggnad av flerskiktskartong In: Papp och kartong, Markaryd, SUM AB, ISBN 91-7322-182-1, p. 15-17, Tabell 1.
Notice from Swedish Patent and Registration office from corresponding priority application No. 2051027-7, dated Mar. 23, 2021.
Notice from Swedish Patent and Registration office from corresponding priority application No. 2051027-7, dated Nov. 10, 2021.
International Search Report from corresponding PCT application No. PCT/US2021/057942 mailed Nov. 1, 2021.
Gary Chinga-Carrasco, Cellulose fibres, nanofibrils and microfibrils: The morphological sequence of MFC components from a plant physiology and fibre technology point of view, Chinga-Carrasco Nanoscale Research Letters, 2011, 6:417.

(Continued)

*Primary Examiner* — Dah-Wei D. Yuan
*Assistant Examiner* — Nga Leung V Law
(74) *Attorney, Agent, or Firm* — Greer, Burns & Crain, Ltd.

(57) ABSTRACT

The present invention relates to a method for manufacturing a multilayer machine glazed paper comprising highly refined cellulose fibers, the method comprising the steps of: forming a first wet web by applying at least one first pulp suspension comprising highly refined cellulose fibers on a first wire; partially dewatering the first wet web to obtain a first partially dewatered web; forming a second wet web by applying at least one second pulp suspension comprising highly refined cellulose fibers on a second wire; partially dewatering the second wet web to obtain a second partially dewatered web; joining the first and second partially dewatered web to obtain a multilayer web; optional dewatering the multilayer web in a dewatering unit, and glazing the multilayer web in at least one glazing unit to obtain a multilayer machine glazed paper comprising highly refined cellulose fibers. The invention also relates to a multiply MG paper produced according to the method.

13 Claims, No Drawings

(56) References Cited

FOREIGN PATENT DOCUMENTS

| | | | |
|---|---|---|---|
| JP | 2019183370 | A | 10/2019 |
| JP | 2020525667 | A | 8/2020 |
| SE | 1650900 | A1 | 11/2017 |
| WO | 2019189776 | A1 | 10/2019 |
| WO | 2020046628 | A2 | 3/2020 |
| WO | 2021209918 | A1 | 10/2021 |
| WO | 2021260608 | A1 | 12/2021 |

OTHER PUBLICATIONS

D. Fengel, Ultrastructural behaviour of cell wall polysaccharides, TAPPI, 1970, vol. 53, No. 3, pp. 497-503.
Peter J. Walker, High temperature Yankee Hoods Save Energy and Improve Quality, P&P, Jul. 2007.
Extended European Search report from corresponding European application No. 21863806.2 dated Sep. 2, 2024.

* cited by examiner

METHOD FOR PRODUCING A MULTILAYER MACHINE GLAZED PAPER COMPRISING HIGHLY REFINED CELLULOSE FIBERS AND A MULTILAYER MACHINE GLAZED PAPER PRODUCED

This application is a U.S. National Phase under 35 U.S.C. § 371 of International Application No. PCT/IB2021/057942 filed Aug. 31, 2021, which claims priority under 35 U.S.C. §§ 119 and 365 to Swedish Application No. 2051027-7 filed Sep. 1, 2020.

TECHNICAL FIELD

The present disclosure relates a method for producing a multilayer machine glazed (MG) paper comprising highly refined cellulose fibers, particularly a multilayer MG paper comprising microfibrillated cellulose (MFC).

BACKGROUND

Machine glazed (MG) paper is a paper used in label paper, special printing applications and in different food and hygiene packaging applications. Normally, one surface of the paper is glazed, i.e. treated in such a way that the gloss of the surface of the paper is increased. The glazing of the at least one surface of the paper is done in order to provide the paper with improved gloss and increased surface density without losing too much bulk. The glazed surface improves the barrier properties, especially improved barrier against grease and oil as well as it gives the surface improved printing properties. Besides having good barrier properties, it is important that the MG paper also has good mechanical strength in order for it to cope with the high demands in the different end applications.

Microfibrillated cellulose (MFC) is known to be used as a strength additive or barrier additive when producing paper or paperboard products. However, MFC has a very high water binding capacity and it is thus very difficult to reduce the water content of a slurry comprising microfibrillated cellulose and the dewatering demand for a product comprising high amounts of MFC is very high. Thus, it is difficult to dewater a product comprising high amounts of MFC without deteriorating the mechanical or barrier properties of the product.

During production of machine glazed paper it is important that the runnability of the paper is improved. By adding barrier or strength additives to the paper there is a risk with lifting or blistering of the web during drying and glazing.

There is thus a need for a new method to produce an improved MG paper having good strength and barrier properties in an efficient way.

DESCRIPTION OF THE INVENTION

It is an object of the present disclosure to provide a method for manufacturing a machine glazed paper comprising highly refined cellulose fibers, such as microfibrillated cellulose (MFC), which alleviates at least some of the above-mentioned problems associated with prior art methods.

It is a further object of the present disclosure to provide a method for manufacturing a machine glazed paper comprising highly refined cellulose fibers with improved strength and barrier properties in an efficient way.

It is a further object of the present disclosure to provide an improved method for manufacturing a multilayer MG paper comprising highly refined cellulose fibers in a paper- or paperboard machine type of process.

It is a further object of the present disclosure to provide a multilayer machine glazed paper that is strong and useful as a barrier packaging material based on renewable raw materials.

The above-mentioned objects, as well as other objects as will be realized by the skilled person in the light of the present disclosure, are achieved by the various aspects of the present disclosure.

According to a first aspect illustrated herein, there is provided a method for manufacturing a multilayer machine glazed paper comprising highly refined cellulose fibers, the method comprising the steps of:

a) forming a first wet web by applying at least one first pulp suspension comprising highly refined cellulose fibers on a first wire;
b) partially dewatering the first wet web to obtain a first partially dewatered web;
c) forming a second wet web by applying at least one second pulp suspension comprising highly refined cellulose fibers on a second wire;
d) partially dewatering the second wet web to obtain a second partially dewatered web;
e) joining the first and second partially dewatered web to obtain a multilayer web;
f) optional dewatering the multilayer web in a dewatering unit, and
g) glazing the multilayer web in at least one glazing unit to obtain a multilayer machine glazed paper comprising highly refined cellulose fibers.

The term machine glazed paper as used herein refers generally to a paper product with at least one glazed surface. The machine glazed paper preferably has a grammage in the range of 25-160 g/m$^2$.

The inventive method allows for manufacturing a multilayer machine glazed paper comprising highly refined cellulose fibers in a paper machine type of process. By the present invention it was found possible to produce a multilayer MG paper comprising highly refined fibers, preferably microfibrillated cellulose, with improved strength and barrier properties in a more efficient way.

The manufacturing method involves the separate preparation and partial dewatering of at least two webs, the two webs has a lower grammage compared to the finalized multilayer MG paper. The partially dewatered but still wet webs are joined to form a higher grammage multilayer web, which is subsequently optionally further dewatered and dried to obtain a more dry multilayer web. Joining the webs while they are still wet ensures good adhesion between the layers. In fact, if the composition of the two layers is identical, the resulting multilayer paper may even be difficult to distinguish from a single layer paper of corresponding thickness. The partial dewatering and lamination of the webs in the partially dewatered state has been found to substantially eliminate occurrence of pinholes in the finished multilayer paper, while still allowing a high production speed. In the prior art, increased dewatering speed has sometimes been achieved by using large amounts of retention and drainage chemicals at the wet end of the process, causing increased flocculation. However, retention and drainage chemicals may also cause a more porous web structure, and thus there is a need to minimize the use of such chemicals. The inventive method provides an alternative way of increasing dewatering speed, which is less dependent on the addition of retention and drainage chemicals. The joined multilayer web is thereafter glazed in at least one glazing unit to obtain a multilayer machine glazed paper comprising highly refined cellulose fibers.

A paper machine (or paper-making machine) is an industrial machine which is used in the pulp and paper industry to create paper in large quantities at high speed. Modern paper-making machines are typically based on the principles of the Fourdrinier Machine, which uses a moving woven mesh, a "wire", to create a continuous web by filtering out the fibers held in a pulp suspension and producing a continuously moving wet web of fiber. This wet web is dried in the machine to produce a strong paper web.

The forming, dewatering and joining steps of the inventive method are preferably performed at the forming section of the paper machine, commonly called the wet end. The wet webs are formed on different wires in the forming section of the paper machine. The preferred type of forming section for use with the present invention includes 2 or 3 Fourdrinier wire sections, combined with supporting wire. The wires are preferably endless wires. The wire used in the inventive method preferably has relatively high porosity in order to allow fast dewatering and high drainage capacity.

The at least one first and at least one second pulp suspensions are aqueous suspensions comprising a water-suspended mixture of cellulose based fibrous material and optionally non-fibrous additives. The inventive method uses pulp suspensions comprising highly refined cellulose fibers. Refining, or beating, of cellulose pulps refers to mechanical treatment and modification of the cellulose fibers in order to provide them with desired properties. The highly refined cellulose fibers can be produced from different raw materials, for example softwood pulp or hardwood pulp. The highly refined cellulose fibers are preferably never dried cellulose fibers.

The term highly refined cellulose fibers as used herein preferably refers to refined cellulose fibers having a Schopper-Riegler (SR) value of 65 or higher, preferably 70 or higher, preferably above 85, preferably between 75-100 or even more preferred between 85-99 as determined by standard ISO 5267-1.

The dry solids content of the first and/or second pulp suspension is typically in the range of 0.1-0.7 wt %, preferably in the range of 0.15-0.5 wt %, more preferably in the range of 0.2-0.4 wt %.

The first and/or second pulp suspension comprises a mixture of highly refined cellulose fibers, unrefined or slightly refined fibers and optional other ingredients or additives. In some embodiments, the first and/or second pulp suspension comprises at least 0.1 wt %, preferably at least 2 wt %, more preferably at least 5 wt % or at least 10 wt % of highly refined cellulose fibers, based on the total dry weight of the pulp suspension. It is preferred that the first and/or second pulp suspension comprises 0.1-50 wt %, preferably between 2-40 wt % or between 5-30 wt % or even more preferred between 10-25 wt % of highly refined fibers. The highly refined fibers may be produced from bleached pulp to produce a white paper product or unbleached pulp to produce a brown paper product.

In some embodiments, the highly refined cellulose fibers of the first and/or second pulp suspension is refined Kraft pulp. Refined Kraft pulp will typically comprise at least 10% hemicellulose. Thus, in some embodiments the first and/or second pulp suspension comprises hemicellulose at an amount in the range of 10-25%, of the amount of the highly refined cellulose fibers.

The first and/or second pulp suspension may further comprise additives such as native starch or starch derivatives, cellulose derivatives such as sodium carboxymethyl cellulose, a filler, retention and/or drainage chemicals, flocculation additives, deflocculating additives, dry strength additives, softeners, cross-linking aids, sizing chemicals, dyes and colorants, wet strength resins, fixatives, de-foaming aids, microbe and slime control aids, or mixtures thereof. The first and/or second pulp suspension may further comprise additives that will improve different properties of the mixture and/or the produced paper such as latex and/or polyvinyl alcohol (PVOH). The inventive method provides an alternative way of increasing dewatering speed, which is less dependent on the addition of retention and drainage chemicals, but smaller amounts of retention and drainage chemicals may still be used.

The highly refined fibers are preferably microfibrillated cellulose (MFC). Microfibrillated cellulose (MFC) shall in the context of the patent application be understood to mean a nano scale cellulose particle fiber or fibril with at least one dimension less than 1000 nm. MFC comprises partly or totally fibrillated cellulose or lignocellulose fibers. The liberated fibrils have a diameter less than 100 nm, whereas the actual fibril diameter or particle size distribution and/or aspect ratio (length/width) depends on the source and the manufacturing methods. The smallest fibril is called elementary fibril and has a diameter of approximately 2-4 nm (see e.g. Chinga-Carrasco, G., *Cellulose fibres, nanofibrils and microfibrils, The morphological sequence of MFC components from a plant physiology and fibre technology point of view, Nanoscale research letters* 2011, 6:417), while it is common that the aggregated form of the elementary fibrils, also defined as microfibril (Fengel, D., *Ultrastructural behavior of cell wall polysaccharides*, Tappi J., March 1970, Vol 53, No. 3), is the main product that is obtained when making MFC e.g. by using an extended refining process or pressure-drop disintegration process. Depending on the source and the manufacturing process, the length of the fibrils can vary from around 1 to more than 10 micrometers. A coarse MFC grade might contain a substantial fraction of fibrillated fibers, i.e. protruding fibrils from the tracheid (cellulose fiber), and with a certain amount of fibrils liberated from the tracheid (cellulose fiber).

There are different acronyms for MFC such as cellulose microfibrils, fibrillated cellulose, nanofibrillated cellulose, fibril aggregates, nanoscale cellulose fibrils, cellulose nanofibers, cellulose nanofibrils, cellulose microfibers, cellulose fibrils, microfibrillar cellulose, microfibril aggregates and cellulose microfibril aggregates. MFC can also be characterized by various physical or physical-chemical properties such as its large surface area or its ability to form a gel-like material at low solids (1-5 wt %) when dispersed in water.

Various methods exist to make MFC, such as single or multiple pass refining, pre-hydrolysis followed by refining or high shear disintegration or liberation of fibrils. One or several pre-treatment steps are usually required in order to make MFC manufacturing both energy efficient and sustainable. The cellulose fibers of the pulp to be utilized may thus be pre-treated, for example enzymatically or chemically, to hydrolyse or swell the fibers or to reduce the quantity of hemicellulose or lignin. The cellulose fibers may be chemically modified before fibrillation, such that the cellulose molecules contain other (or more) functional groups than found in the native cellulose. Such groups include, among others, carboxymethyl (CMC), aldehyde and/or carboxyl groups (cellulose obtained by N-oxyl mediated oxidation, for example "TEMPO"), quaternary ammonium (cationic cellulose) or phosphoryl groups. After being modified or oxidized in one of the above-described methods, it is easier to disintegrate the fibers into MFC or nanofibrils.

The nanofibrillar cellulose may contain some hemicelluloses, the amount of which is dependent on the plant source. Mechanical disintegration of the pre-treated fibers, e.g. hydrolysed, pre-swelled, or oxidized cellulose raw material is carried out with suitable equipment such as a refiner, grinder, homogenizer, collider, friction grinder, ultrasound sonicator, fluidizer such as microfluidizer, microfluidizer or fluidizer-type homogenizer. Depending on the MFC manufacturing method, the product might also contain fines, or nanocrystalline cellulose, or other chemicals present in wood fibers or in papermaking process. The product might also contain various amounts of micron size fiber particles that have not been efficiently fibrillated.

MFC is produced from wood cellulose fibers, both from hardwood and softwood fibers. It can also be made from microbial sources, agricultural fibers such as wheat straw pulp, bamboo, bagasse, or other non-wood fiber sources. It is preferably made from pulp including pulp from virgin fiber, e.g. mechanical, chemical and/or thermomechanical pulps. It can also be made from broke or recycled paper.

In some embodiments, at least some of the MFC is obtained from MFC broke.

In addition to the highly refined cellulose fibers, the first and/or second pulp suspension comprises a certain amount of unrefined or slightly refined cellulose fibers. The term unrefined or slightly refined fibers as used herein preferably refers to cellulose fibers having a Schopper-Riegler (SR) value below 30, preferably below 28, as determined by standard ISO 5267-1. In some embodiments, the first and/or second pulp suspension comprises between 50-99.9 wt %, preferably between 60-98 wt %, and more preferably between 70-95 wt % or even more preferred between 75 to 90 wt % of unrefined or slightly refined cellulose fibers, based on the total dry weight of the pulp suspension. The unrefined or slightly refined cellulose fibers may for example be obtained from chemical pulp, such as kraft pulp, mechanical or chemomechanical pulp or other high yield pulps. The unrefined or slightly refined cellulose fibers may be obtained from bleached or unbleached pulp. The unrefined or slightly refined cellulose fibers are preferably pulp from never dried cellulose fibers.

The composition of the first and second pulp suspension may be the same or different.

For example, in some embodiments one of the pulp suspensions may comprise a higher amount of highly refined fibers compared to the other pulp suspension. One possibility is to have a first pulp suspension with less highly refined cellulose fibers with lower SR value and/or a higher amount of unrefined or slightly refined cellulose fibers to provide faster dewatering, and a second pulp suspension with more highly refined cellulose fibers with higher SR value and/or a lower amount of unrefined or slightly refined cellulose fibers to provide good barrier properties and high strength. It may be preferred to use a lower amount of highly refined fibers in the suspension to form the web to in direct contact with the glazing unit. Consequently, by changing the compositions of the suspension it is possible to design the multiply web in such a way that the web that is not in direct contact with the glazing unit will comprise a higher amount of highly refined fibers, preferably in an amount of 20-50 wt-%, preferably in an amount of 25-40 wt-%. In this way it is still possible to produce a multilayer machine glazed paper with good strength in an efficient way In some embodiments, the first and second pulp suspension are provided from two different headboxes. This may be advantageous since the headboxes can be operated in slightly different manners, e.g. with different consistencies, head box jet angles, or jet-to-wire ratios.

It might also be possible to use more than one multiply headboxes. In this way the first suspension can be subjected through a first multiply headbox forming a first web comprising more than one layer, i.e. a first multiply wet web and the second suspension can be subjected through a second multiply headbox forming a second web comprising more than one layer, i.e. a second multiply wet web. In this way a multiply web comprising more than one wet web layer from the first suspension and more than one wet web layer from the second suspension is formed. It may be preferred that the first multiply wet web comprises layers from more than the first suspension, e.g. also from a third, a fourth or additional suspensions. It may be possible that the second multiply wet web comprises layers from more than the second suspension, e.g. also from a fifth, sixth or additional suspensions. When using more than one suspension for forming the first and/or second multiply wet web it is preferred that the compositions of the suspensions are different. It is preferred that the suspension forming the inner or mid-ply of the multiply MG paper comprises a higher amount of highly refined fibers. It may be preferred that the suspension used in the outer ply/plies comprises a less amount of highly refined fibers. The suspension/s used in the mid-ply or inner ply/plies preferably comprises 15-50 wt % of highly refined fibers, preferably between 25-40 wt % based on the total dry solid content of the suspension. The suspension/s used in the outer ply/plies preferably comprises an amount of 0.1-10 wt % of highly refined fibers, preferably between 1-5 wt % based on the total dry solid content of the suspension.

The wire used in the inventive method preferably has relatively high porosity in order to allow fast dewatering and high drainage capacity.

In some embodiments, the first and second pulp suspension have the same composition. This can simplify the process as only one pulp suspension source is required.

The basis weight of each of the first and/or second wet web based on the total dry weight of the web is preferably less than 80 g/m$^2$ and more preferably less than 60 g/m$^2$. A low grammage has been found to allow for a quick partial dewatering of the wet web with little pinhole formation. The basis weight of the first and/or second wet web based on the total dry weight of the web is preferably at least 5 g/m$^2$. Thus, in some embodiments, the basis weight of the first and/or second wet web based on the total dry weight of the web is in the range of 5-80 g/m$^2$, more preferably in the range of 10-60 g/m$^2$.

After being formed, the first and second wet web are partially dewatered. Dewatering of the webs on the wire may be performed using methods and equipment known in the art, examples include but are not limited to table roll and foils, friction less dewatering and ultra-sound assisted dewatering. Partial dewatering means that the dry solids content of the wet web is reduced compared to the dry solids content of the pulp suspension, but that the dewatered web still comprises a significant amount of water. In some embodiments, partial dewatering of the wet webs means that the dry solids content of the first and second partially dewatered web is above 1 wt % but below 15 wt %. In some embodiments, partial dewatering of the wet webs means that the dry solids content of the first and second partially dewatered web is above 1 wt % but below 10 wt %. A dry solids content of the first and second partially dewatered web in this range has been found to be especially suitable for joining the first and second wet web into a multilayer web. In some embodiments, the dry solids content of the first and second partially dewatered web prior to the joining step is in the range of 1.5-8 wt %, preferably in the range of 2.5-6 wt %, and more preferably in the range of 3-4.5 wt %.

The partially dewatered but still wet webs are joined to form a higher grammage multilayer web. The dry solids content of the first and second partially dewatered web when they are joined is preferably above 1 wt % but below 15 wt % and more preferably above 1 wt % but below 10 wt %. In some embodiments, the dry solids content of the first and second partially dewatered web when they are joined is in the range of 1.5-8 wt %, preferably in the range of 2.5-6 wt %, and more preferably in the range of 3-4.5 wt %. The partially dewatered webs are preferably joined by wet lamination. When the pulp suspension is dewatered on the wire a visible boundary line will appear at a point where the web goes from having a reflective water layer to where this reflective layer disappears. This boundary line between the reflective and non-reflective web is referred to as the waterline. The waterline is indicative of a certain solids content of the web. The webs are preferably joined after the water line. Joining the webs while they are still wet ensures good adhesion between the layers. The joining can be achieved by applying one of the partially dewatered webs on top of the other. The joining may be done non-wire side against non-wire side, or wire-side against non-wire side. Joining and further dewatering of the formed multilayer web may be improved by various additional operations. In some embodiments, the joining further comprises pressing the first and second partially dewatered web together. In some embodiments, the joining further comprises applying suction to the joined first and second partially dewatered web. Applying pressure and/or suction to the formed multilayer web improves adhesion between the web layers. The wire section of a paper machine may have various dewatering devices such as blade, table and/or foil elements, suction boxes, friction less dewatering, ultra-sound assisted dewatering, couch rolls, or a dandy roll.

The surface of the web facing the wire is referred to as the wire side and the surface of the web facing away from the wire is referred to as the non-wire side.

When dewatering a web comprising highly refined cellulose fibers, particularly MFC, on a wire it has been found that there will be a difference in fines contents between the non-wire side and the wire side. Fines are typically concentrated at the non-wire side and more fines are washed away from the wire side where the dewatering occurs. This difference or imbalance in the web composition cause problems with curling of the finished paper due to changes in humidity. Forming a multilayer paper according to the invention can solve or ameliorate this problem by reducing the imbalance in the web composition.

The joining of the webs may preferably be done non-wire side against non-wire side, or non-wire side against wire side. Joining the webs non-wire side against non-wire side, or wire side against non-wire side gives an additional advantage in that a larger portion of fines is concentrated towards the middle of the multilayer paper. This concentration of fines contributes both to adhesion between the layers and to the barrier properties of the paper. The fines may also contribute to a self-healing phenomenon, where fines redistribute to fill voids in the felted sheet on the wet wire, thus making produced paper less porous. Another advantage is that the amount of fines on the surface to be glazed is reduced which improves the adhesion properties of the web to the surface of the glazing unit and the runnability.

Joining the webs non-wire side against non-wire side is preferred, since i) fines will be concentrated in the middle, ii) the paper structure will be symmetrical, reducing curling problems, iii) high concentration of fines at contact surfaces will ensure good bonding between layers, and iv) more porous outer surfaces (wire sides) allow for more efficient dewatering in the press section and faster drying.

The dry solids content of the multilayer web is typically further increased during the joining step. The increase in dry solids content may be due to dewatering of the multilayer web on the wire with optional pressure and/or suction applied to the web, and also due to drying operations performed during or shortly after the joining, e.g. impingement drying or air or steam drying. The dry solids content of the multilayer web after joining, with optional application of pressure and/or suction, is typically above 8 wt % but below 28 wt %. In some embodiments, the dry solids content of the multilayer web prior to the further dewatering and optional drying step is in the range of 8-28 wt %, preferably in the range of 10-20 wt %, and more preferably in the range of 12-18 wt %.

The basis weight of the multilayer web, and the multilayer MG paper, based on the total dry weight of the web is typically less than 160 g/m$^2$, preferably less than 140 g/m$^2$, and more preferably less than 130 g/m$^2$. In some embodiments, the basis weight of the multilayer web, and the multilayer machine glazed paper, based on the total dry weight of the web is in the range of 25-160 g/m$^2$, preferably in the range of 30-140 g/m$^2$, more preferably in the range of 40-130 g/m$^2$.

The invention is described herein mainly with reference to an embodiment wherein the multilayer MG paper is formed from two web layers comprising highly refined cellulose fibers. However, it is understood that the multilayer MG paper may also comprise additional web layers comprising highly refined cellulose fibers. Thus, it is also possible that the formed multilayer MG paper is formed from three or more web layers comprising highly refined cellulose fibers, such as three, four, five, six, or seven layers. The forming, composition and structure of each additional layer may be further characterized as described above with reference to the first and second web layer. Thus, in some embodiments the method for manufacturing a multilayer paper further comprises the steps:

c2) forming a third wet web by applying a third pulp suspension comprising highly refined cellulose fibers on a third wire;

d2) partially dewatering the third wet web to obtain a third partially dewatered web;

e2) joining the first, second and third partially dewatered web to obtain a multilayer web.

If a MG paper with three or more web layers are produced it may be preferred that the first and third suspension has the same composition, preferably comprising a lower amount of highly refined fibers and the second furnish to produce the second layer which will be located between the first and third layer comprises a higher amount of highly refined fibers. It may be preferred that the first and third pulp suspension comprises between 0.1-10 wt % of highly refined fibers, preferably in an amount of 1-5 wt % and the second pulp suspension comprises between 15-50 wt-%, preferably between 25-40 wt-% of highly refined fibers.

After dewatering of the multiply web it may be possible to subject the web to further dewatering. The further dewatering typically comprises pressing the web to squeeze out as much water as possible. The further dewatering may for example include passing the formed multilayer web through a press section of a paper machine, where the web passes between large rolls loaded under high pressure to squeeze out as much water as possible. The removed water is typically received by a fabric or felt. In some embodiments, the dry solids content of the multilayer web after the further dewatering is in the range of 15-40 wt %, preferably in the range of 18-35 wt %, and more preferably in the range of 20-30 wt %.

It may be possible to optional subject the multilayer web to additional dewatering in a dewatering unit in dewatering step f). The dewatering unit is preferably a shoe press, a belt press or similar extended nip pressing equipment with a nip length of at least 150 mm. It was found that the use of a shoe press, belt press or similar extended nip pressing equipment made it possible to improve the dewatering of the multilayer web without increasing the risk for wet blistering of the web and destroying the barrier properties of the multilayer MG paper. The extended nip pressing equipment preferably has a nip length of at least 150 mm, preferably at least 200 mm, preferably between 150-350 mm, and even more preferred between 200 and 300 mm. The linear load in expended nip pressing equipment is preferably between 250-1500 kN/m, i.e. this is the maximum linear load to be used in the equipment, e.g. the shoe press. It is preferred that the linear load used is changed during the treatment of the multilayer web. By gradually or stepwise increasing the linear load in the extended nip pressing equipment, the dewatering of the web is improved, i.e. a web with a higher dry solid content can be produced without destroying the barrier properties. It is also possible that the linear load is increased at a pulse during treatment in the nip, i.e. the linear load is increased at least one time in at least one pulse during treatment of the multilayer web in the shoe pres. This can be repeated during treatment in the extended nip pressing equipment. If more than one extended nip pressing equipment, e.g. shoe presses, is used it is possible to use the same linear load profile in both equipment. However, it is often preferred to use different linear load profiles to design the linear load profile in such a way that the dewatering is improved without deteriorating the barrier properties of the dewatered multilayer web.

With shoe press is meant an extended nip pressing equipment comprising a shoe press nip. Any known shoe press can be used. The shoe press nip can either be formed by using a shoe and a roll or by using a large diameter soft roll and a roll. The roll preferably has a synthetic belt but it can also have a metal belt. The large diameter soft roll can have a diameter of 1.5-2 meters. The position of the shoe in relation to the fibrous web can be changed by changing the tilt angle of the shoe press. The tilt angle of the at least one shoe press is preferably between 7-24 degrees. The tilt angle affects the peak linear load and is a way to adjust the linear load to improve the dewatering efficiency of the web. The nip time is preferably at least 30 ms. Depending on the nip length and the production speed the time in which the multilayer web is subjected to the pressure in the shoe press varies.

The dry solids content of the multiply web after the optional dewatering step is preferably between 25-45 wt %.

With belt press is meant an extended nip pressing equipment comprising a belt. Any known belt presses can be used.

It may be preferred to use at least two extended nip pressing equipment, preferably at least two shoe presses, and that the two extended nip pressing equipment are being located after each other. The multiply web is then first conducted through a first shoe press and then through the second shoe press. In this way it was found possible to even further improve the dewatering of the web and to improve the production efficiency meaning that the amount of MFC can be increased. The nip pressure used in the first shoe press is preferably lower than the nip pressure used in the second shoe press. The at least two shoe presses are preferably located at different sides of said web. In this way it is possible to dewater the web from both directions through the fibrous web. When more than one shoe press is used is it preferred that the total nip length, i.e. the sum of the nip lengths of each shoe press, is above 350 mm, preferably above 400 mm and even more preferred above 450 mm. The geometric design of the at least two shoe presses is preferably different, e.g. one shoe press can have a concave design and one shoe press can have a convex design.

After the optional dewatering step in the dewatering unit the multiply web is conducted through a glazing unit where at least one side of the multiply web is glazed. The glazing unit may be a Yankee cylinder, a glassine calender or an extended nip calender such as a shoe calender or belt calender. The glazing unit is preferably a Yankee cylinder. It was found that the use of a Yankee cylinder as a glazing unit made it possible to both dry and provide the at least one surface of the multiply web with a glazed surface. Yankee Cylinders are normally used for drying tissue papers that is a very porous material. The use of Yankee Cylinders and how the drying affects paper is well described by Walker, in the article "High temperature Yankee Hoods Save Energy and Improve Quality, P&P, July 2007. When using a Yankee Cylinder for drying products, the liquid in the products flows through the product towards the Yankee cylinder, i.e. towards the heat and the steam that is formed during the drying. The liquid of the product in our case also comprises microfibrils which leads to that an increased concentration of microfibrils is achieved on the smoothened and glazed surface of the paper.

The dry solids content of the multilayer web prior to glazing the multilayer web is preferably in the range of 35-85 wt %, preferably in the range of 45-85 wt %. it is important that the dry solids content of the multilayer web is regulated in order to ensure that the glazing treatment is efficient as possible. Also, the correct dry solid content of the web will minimize the risk with adhesion problems of the web on the surface of the glazing unit.

The temperature of the glazing unit is preferably above 100° C., preferably between 110-190° C. The first side of the multiply web will be in direct contact with the glazing unit, e.g. in direct contact with the surface of the Yankee cylinder, extended nip calender or glassine calender. In order to control the adhesion of the fibrous web to the glazing unit, e.g. Yankee cylinder, it may be preferred to add adhesion control additives to the surface of the glazing unit. It has been found important to control the adhesion to the surface of the glazing unit when microfibrillated cellulose is used since the microfibrillated cellulose in the fibrous web tend to make the fibrous web too tense which causes lifting or blistering of the web from the surface of the glazing unit. The adhesion control additives will provide sufficient adhesion of the web to the surface of the glazing unit. Suitable adhesion control additives may be water-soluble or partly water-soluble polymers such as polyvinyl alcohol (PVOH), polyamide-amine derivate, polyethylene imine, polyacrylamide and/or polyacrylamide derivate. The degree of hydrolysis of the PVOH used is preferably less than 99%, even more preferred less than 98%. It is also possible to use modified polymers, such as modified PVOH, preferably ethylene, carboxylated, cationized or siliconized PVOH. The adhesion control additive may also comprise nanoparticles, such as nanoclay and/or nanocellulose. The adhesion control additive may also comprise between 0.5-20 wt-% of nanoparticles based on total dry weight. The amount of adhesion control additive to the surface of the glazing unit is preferably between 0.1-10 gsm dry weight. The adhesion control additive is preferably added to the surface of the glazing unit by spraying. The adhesion control additive is preferably added to the surface of the glazing unit as a solution or as a foam.

The multiply web may be calendered in at least one calender after being conducted through the glazing unit. Any know calender can be used, such as machine calender, multi-nip calender, soft-nip calender, belt calender. It may be preferred to use a shoe calender or any other extended nip calender. It is possible to calender one or both sides of the machine glazed paper. The treatment in the calender is preferably done in-line.

The fibrous web may be treated in a de-curling unit after being calendered. In this way it is possible to even further reduce the curling tendency of the paper.

The produced multilayer machine glazed paper is preferably coated on at least one side with a coating composition. The coating composition preferably comprises starch, carboxymethyl cellulose and/or microfibrillated cellulose. It is preferred that the coating is applied to the glazed surface of the MG paper. The coating composition will further improve the barrier properties of the paper. It was surprisingly found that the addition of highly refined fibers to the paper improved the coating properties of the paper, i.e. the coverage of the coating on the surface of the paper is strongly improved. One theory is that the density of the glazed surface is increased meaning that the coating "stays" on the surface of the paper and it is possible to reduce the coating amount and still be able to achieve a full coating coverage on the surface. It is preferred that the coating is applied in amount of 0.1-5 gsm, preferably between 0.2-4 gsm and even more preferred between 0.3-3 gsm. Any known coating techniques may be used to apply the coating composition to the surface of the paper.

The multilayer MG paper preferably has high repulpability. In some embodiments, the multilayer MG paper exhibits less than 30%, preferably less than 20%, and more preferably less than 10% reject, when tested as a category II material according to the PTS-RH 021/97 test method.

According to a second aspect illustrated herein, there is provided a multilayer machine glazed paper comprising highly refined cellulose, wherein the multilayer MG paper is obtainable by the inventive method.

The multilayer machine glazed paper preferably comprises between 0.1-50 wt % of highly refined fibers based on total dry solid content, more preferably between 2-40 wt % and even more preferably between 5-30 wt %.

The multilayer machine glazed paper preferably has a basis weight in the range of 25-160 g/m$^2$, preferably in the range of 30-140 g/m$^2$, more preferably in the range of 40-130 g/m$^2$.

The multilayer machine glazed preferably has an Oxygen Transmission Rate (OTR) value (23° C., 50% RH) below 200 cc/m$^2$/24 h according to ASTM D-3985, preferably below 150 cc/m$^2$/24 h and even more preferred below 100 cc/m$^2$/24 h.

The multilayer machine glazed paper preferably has Gurley Hill value of at least 25000 s/100 ml, and more preferably at least 40 000 s/100 ml, as measured according to standard ISO 5636/6.

The multilayer machine glazed paper preferably has at least one glazed surface with a surface roughness PPS value below 5 μm according to ISO 8791-4, preferably below 2 μm (measured before adding any eventual coating).

The multilayer machine glazed paper preferably has a Scott Bond value above 1500 J/m$^2$, more preferably above 1600 J/m$^2$ and most preferably above 1800 J/m$^2$ measured according to TAPPI UM-403 on a 60 gsm paper. Consequently, the multilayer MG paper produced has very high strength.

The multilayer MG paper will typically exhibit good resistance to grease and oil. Grease resistance of the paper is evaluated by the KIT-test according to standard ISO 16532-2. The test uses a series of mixtures of castor oil, toluene and heptane. As the ratio of oil to solvent is decreased, the viscosity and surface tension also decrease, making successive mixtures more difficult to withstand. The performance is rated by the highest numbered solution which does not darken the sheet after 15 seconds. The highest numbered solution (the most aggressive) that remains on the surface of the paper without causing failure is reported as the "kit rating" (maximum 12). In some embodiments, the KIT value of the multilayer MG paper is at least 6, preferably at least 8, and even more preferred at least 10, as measured according to standard ISO 16532-2.

The inventive multilayer machine glazed papers are especially suited as a packaging material, especially as a wrapping of food or hygiene products.

Generally, while the products, polymers, materials, layers and processes are described in terms of "comprising" various components or steps, the products, polymers, materials, layers and processes can also "consist essentially of" or "consist of" the various components and steps.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A method for manufacturing a multilayer machine glazed paper comprising highly refined cellulose fibers, the method comprising the steps of:

a) forming a first wet web by applying at least one first pulp suspension comprising highly refined cellulose fibers having a Schopper-Riegler (SR) value in the range of 65-99 as determined by standard ISO 5267-1 on a first wire;

b) partially dewatering the first wet web to obtain a first partially dewatered web;

c) forming a second wet web by applying at least one second pulp suspension comprising highly refined cellulose fibers having a Schopper-Riegler (SR) value in the range of 65-99 as determined by standard ISO 5267-1 on a second wire;

d) partially dewatering the second wet web to obtain a second partially dewatered web;

e) joining the first and second partially dewatered webs to obtain a multilayer web; and, f) glazing the multilayer web in at least one glazing unit to obtain a multilayer machine glazed paper comprising highly refined cellulose fibers, wherein the at least one glazing unit is a Yankee cylinder, wherein the first pulp suspension, the second pulp suspension, or both comprises between 50-99.9 wt % of unrefined or slightly refined cellulose fibers having a Schopper-Riegler (SR) value below 30, as determined by standard ISO 5267-1, based on a total dry weight of the respective pulp suspension, and wherein the first pulp suspension and, the second pulp suspension comprise 0.1-40 wt % highly refined cellulose fibers based on a total dry weight of the respective pulp suspension, wherein the first pulp suspension and the second pulp suspension have different compositions such that one of the first pulp suspension and the second pulp suspension comprises a lower amount of the highly refined cellulose fibers and a higher amount of the unrefined or slightly refined cellulose fibers than the other of the first pulp suspension and the second pulp suspension, and wherein the multilayer web is arranged such that a surface formed from the one pulp suspension comprising the lower amount of the highly refined cellulose fibers is directly contacted with the Yankee cylinder during glazing.

2. The method according to claim 1, wherein the highly refined pulp in the first pulp suspension, or the second pulp suspension, or both has a Schopper-Riegler (SR) value in the range of 80-95, as determined by standard ISO 5267-1.

3. The method according to claim 1, wherein the highly refined cellulose fibers is microfibrillated cellulose (MFC).

4. The method according to claim 1, wherein the first pulp suspension, or the second pulp suspension, or both comprise between 60-98 wt % of unrefined or slightly refined cellulose fibers, based on a total dry weight of the pulp suspension.

5. The method according to claim 1, wherein the first and second pulp suspensions have the same composition.

6. The method according to claim 1, wherein the first and second pulp suspensions have different composition.

7. The method according to claim 1, wherein the first wet web, or the second wet web, or both comprise more than one layer.

8. The method according to claim 1, wherein a dry solids content of the first and second partially dewatered webs prior to the joining step is each in the range of 1.5-8 wt %.

9. The method according to claim 1, wherein the joining is performed by wet lamination of the first and second partially dewatered webs.

10. The method according to claim 1, further comprising: dewatering the multilayer web in a dewatering unit, wherein a dry solids content of the multilayer web after the dewatering is in a range of 25-45 wt %.

11. The method according to claim 1, wherein a dry solids content of the multilayer web prior to glazing the multilayer web is in a range of 35-85 wt %.

12. The method according to claim 1, further comprising: dewatering the multilayer web in a dewatering unit, wherein said dewatering unit comprises an extended nip pressing equipment.

13. The method according to claim 1, wherein an adhesion control additive is added to a surface of the glazing unit in an amount of 0.1-10 gsm.

* * * * *